United States Patent [19]

Stewart et al.

[11] Patent Number: 4,942,791

[45] Date of Patent: Jul. 24, 1990

[54] ERGONOMIC HANDLE FOR HAND-HELD TOOLS

[75] Inventors: John F. Stewart; Russell D. Richardson, both of Lexington, S.C.

[73] Assignee: Cooper Industries, Inc., Houston, Tex.

[21] Appl. No.: 406,696

[22] Filed: Sep. 13, 1989

Related U.S. Application Data

[60] Continuation of Ser. No. 393,835, Aug. 14, 1989, which is a division of Ser. No. 258,236, Oct. 14, 1988, abandoned.

[51] Int. Cl.[5] ..... B25B 13/00

[52] U.S. Cl. ..... 81/177.1; 16/116 R

[58] Field of Search ..... 26222/57.44, 53, 177.1; 16/116 R, DIG. 12

[56] References Cited

U.S. PATENT DOCUMENTS

| | | | |
|---|---|---|---|
| 2,871,899 | 2/1959 | Coyle et al. | 16/DIG. 12 X |
| 3,019,673 | 2/1962 | Stöstrand et al. | 16/DIG. 12 X |
| 3,189,069 | 6/1965 | Stowell | 16/116 R X |
| 4,290,465 | 9/1981 | Fee et al. | 81/177.1 |
| 4,523,498 | 6/1985 | Chapman | 81/177.1 |

FOREIGN PATENT DOCUMENTS

| | | | |
|---|---|---|---|
| 1554238 | 10/1979 | United Kingdom | 81/177.1 |

*Primary Examiner*—James G. Smith

*Attorney, Agent, or Firm*—David A. Rose; Ned L. Conley

[57] ABSTRACT

Disclosed is an ergonomic handle for a hand-held tool, in particular for an air tool. The handle has a trilobular shape, designed to provide a secure grip and thereby reduce operator fatigue. The handle is also flared at the end which sits nearest the workpiece. This flared feature allows the operator who presses downward on the handle while operating the tool to avoid having his hand slip past the end of the sleeve. The handle is not an integral part of the tool and can be removed to allow maintenance, repair or replacement of the tool. Moreover, in a preferred embodiment, the handle has a bore along its axis and is provided with a unique locking mechanism which prevents rotational or axial movement of the tool relative to the handle. Optionally, the outer surface of the handle is finished so as to reduce slippage in the event it becomes slick with perspiration or oil, and is made of a thermal insulating material to make use comfortable.

5 Claims, 2 Drawing Sheets

ERGONOMIC HANDLE FOR HAND-HELD TOOLS

This is a divisional continuation of co-pending application Ser. No. 07/393,835 filed on 8/14/89 which is a divisional of application No. 07/258,236, filed 10/14/88, abandoned.

FIELD OF THE INVENTION

The invention relates to an ergonomically designed handle for a hand-held tool, particularly for an air tool, which reduces operator muscle fatigue.

BACKGROUND OF THE INVENTION

In a manufacturing facility engaged in mass production, air tools are often used on the assembly line. In operating an air tool over the course of a typical shift, a worker encounters substantial stresses and strains on muscles and ligaments of the hand and arm. This is particularly true for a rotating air tool, such as a screwdriver, a boltdriver, a nut socket, or a drill, which must be gripped tightly to resist both reaction torque of the tool and to provide the axial force necessary to insure tool engagement.

The stresses and strains increase worker fatigue. This can result in a loss of efficiency or a reduction in product quality. Worker injury can also result, which can lead to loss of work time and a need for a replacement worker, worker's compensation claims, and sometimes even liability for the employer.

The science of ergonomics or human engineering has attempted to answer many of the problems facing today's assembly line workers. Among the problems which have been confronted are those facing a worker operating a rotating tool. Deprag (Tradename) offers a air-powered screwdriver with what is described as an "ergonomic" handle. In cross-section, this handle has four lobes. More specifically, it has four slightly arcuate sides of substantially equal length, with rounded corners, so as to form one lobe at each corner.

The Deprag handle, however, is not truly ergonomic. The four lobed design does not closely fit a gripped hand, and the handle is somewhat difficult to grip over the course of an entire shift. In addition, the handle is an integral part of the tool, and cannot be removed. Thus, if the plastic grip is damaged or not desirable to a particular operator, there are no alternatives but to replace the relatively expensive motor housing/grip or force the operator to use a tool which is damaged or not comfortable to him.

It is clear that what is needed is a handle which is truly ergonomic, in the sense that muscle and ligament strain and fatigue is minimized. Such a handle should also be readily detachable so that the grip can be replaced or the tool can be operated without it, if desired by the operator.

SUMMARY OF THE INVENTION

The invention relates to an ergonomic grip handle for a hand-held tool, in particular for an air tool. The handle is designed to provide a secure grip, which reduces operator fatigue, and so that the operator's hand will not slip axially towards the work piece.

In cross-section, the handle has three arcuate sides of substantially equal length all of which are joined so as to form one lobe at each of three rounded corners This trilobular shape conforms to the shape of a human hand held in the gripping position, with one lobe of the handle seating in each pocket in the hand. This allows the handle to be securely gripped.

This trilobular shape also provides a mechanical lock which reduces the grip effort required to resist the reaction torque of the tool. With the common cylindrical tool housing, this reaction torque is resisted merely by the friction between the operator's hand and the tool outside surface. This friction force is a function of the coefficient of friction between his skin and the tool housing material and grip force. The trilobular shape augments this friction force by providing a mechanical lock force, thereby reducing the grip effort required.

The handle is also flared at the end which is designed to be nearest the workpiece. This feature allows the operator who presses downward on the handle while operating the tool to avoid having his hand slip past the end of the handle.

The handle is preferably not an integral part of the tool and can be removed to allow maintenance, repair or replacement of the tool. Moreover, in a preferred embodiment described below, the handle is designed as a sleeve which fits over the tool, the sleeve being provided with a unique locking mechanism which prevents rotational or axial movement of the tool relative to the sleeve.

Preferably, the outer surface of the handle is finished so as to reduce slippage in the event it becomes coated with perspiration or oil, and is also made of a thermally insulating material which protects the worker's hand against heat or cold. Appearance is also improved by this texture. These and other advantages and features of the invention are more fully described below.

DESCRIPTION OF THE PREFERRED EMBODIMENTS

Figure 1:
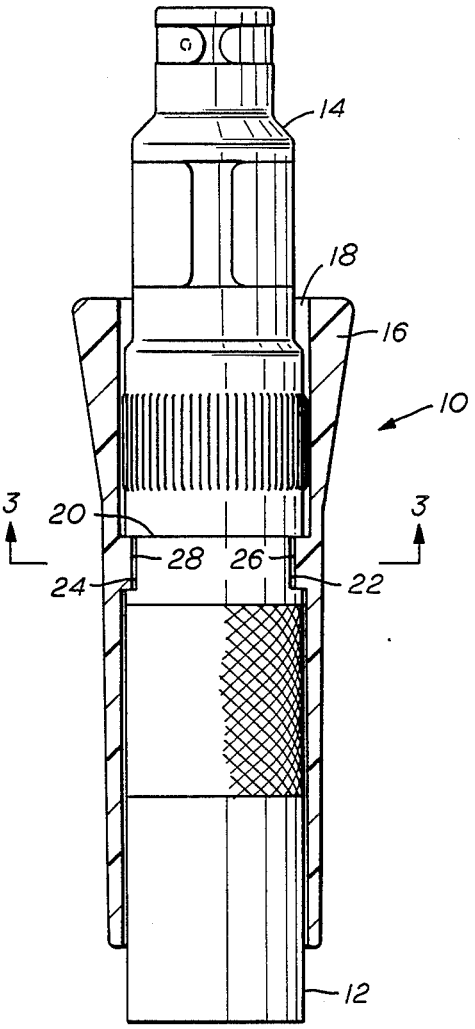
FIG. 1 is a cross-sectional view of an assembled clutch housing and motor housing, with an ergonomic sleeve of the invention in place.
Figure 3:
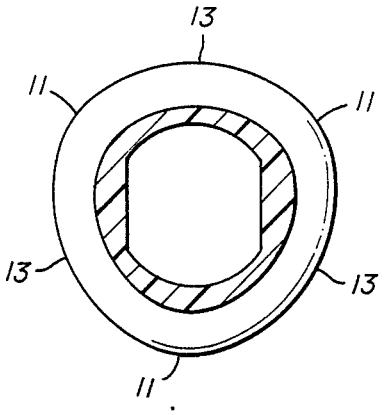
FIG. 3 is cross sectional view of the ergonomic sleeve of the invention, taken at line 3—3 of FIG. 1.

A preferred embodiment of the ergonomic handle of this invention is illustrated in FIG. 1, where the handle is in the form of a tubular sleeve 10, having a cylindrical bore 18. Bore 18 is sized to tightly accommodate an assembled motor housing 12 and clutch housing 14. In cross-section, the outer surface of sleeve 10 has three arcuate sides 13 joined together by rounded corners 11 to form a trilobular cross-section. See FIG. 3. The distance between the middle of each arcuate side of the handle and the opposing corner is preferably from about 3 centimeters to about 4 centimeters, and more preferably is about 3.5 centimeters. These dimensions, together with the trilobular shape of sleeve 10, provide a secure and comfortable grip for a worker's hand.

The outer surface of sleeve 10 is flared outwardly at an end 16, to at least about 1.0 centimeter larger, side to corner, than the main body of the sleeve. The flared section, in combination with the secure grip provided by the trilobular shape of sleeve 10, helps provide substantial resistance to axial movement of a worker's hand gripping sleeve 10 in the direction of flared end 16.

A typical operating assembly designed for use with sleeve 10 has a motor housing 12 which is substantially cylindrical and includes an air motor to drive a tool as well as gears to provide the desired torque for the tool. A clutch housing 14 attaches to motor housing 12 and includes a clutch assembly to provide a driving connection between the motor and the tool.

In order to closely accommodate the clutch assembly, clutch housing 14 includes three cylindrical sections each with a smaller diameter than the adjacent section. The section with the smallest diameter is located at the end of clutch housing 14 furthest from motor housing 12 and closest to the tool itself.

The tool (not shown) extends from the end of clutch housing 14 and is driven through the clutch assembly. The tool may, for example be a rotating tool such as a screwdriver, a nut driver, or a drill. Sleeve 10 could also be used with a non-rotating tool, such as a rivet-driver. Alternatively, a handle having the ergonomic shape of sleeve 10 could be used on a conventional tool which is not air-powered, such as a manual powered screwdriver.

A preferred clutch assembly for use in the invention can be adjusted to impart a specified torque to the nut, bolt, or screw being driven. Typically, the clutch can be adjusted to automatically stop rotation of the tool when the workpiece is torqued a specified amount. The clutch may also start rotation of the tool automatically, upon downward pressure on the tool by the operator.

A preferred assembly for locking sleeve 10 in place on assembled housings 12 and 14, so that sleeve 10 is prevented from relative rotational and axial movement, is shown in FIG. 1. The preferred locking assembly relies upon the interaction of male tabs and female tabs, or "flats," as described below.

Figure 2:
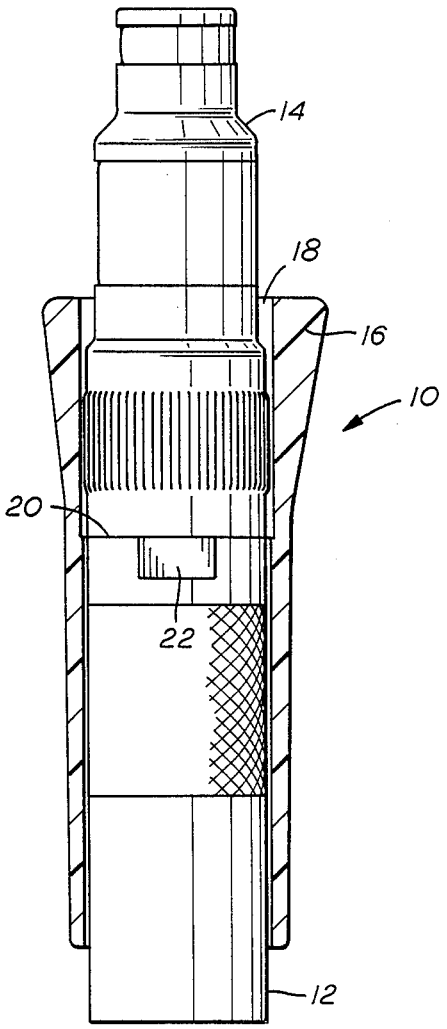
FIG. 2 is a sectional view of the ergonomic sleeve of FIG. 1.
Figure 5:
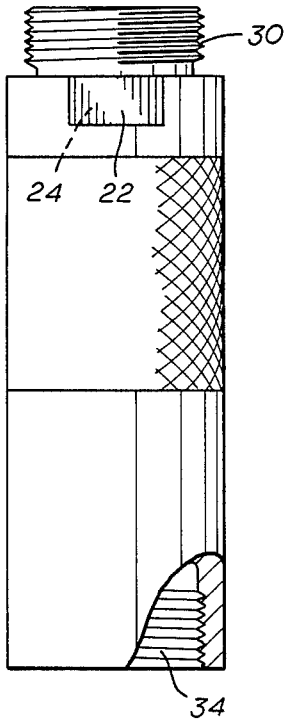
FIG. 5 is a partially cut away view of the motor housing of FIG. 1.

As shown in FIG. 5, the outer surface of motor housing 12 is provided with two female tabs 22 and 24, one on either side thereof. As seen in FIGS. 1 and 2, located on the inner surface of sleeve 10 are male tabs 26 and 28. These two sets of tabs are mated during assembly of the housings and sleeve 10.

To accomplish mating, motor housing 12 is inserted into bore 18 from the end of sleeve 10 opposite flared end 16. Motor housing 12 is then rotated so as to align tabs 22 and 24 with tabs 26 and 28, and pushed inwardly to lock it into place inside sleeve 10.

Figure 4:
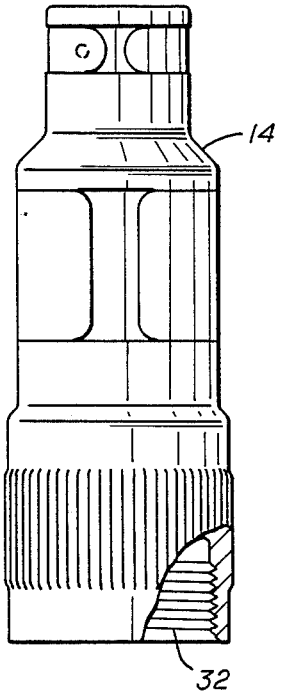
FIG. 4 is a partially cut away view of the clutch housing of FIG. 1.

Clutch housing 14 is next inserted into bore 18 from flared end 16, and is threaded to motor housing 12 via threads 30 and 32 (shown in FIGS. 4 and 5) to form joint 20. If the tool is primarily rotating clockwise, i.e., if used for inserting a right-hand threaded bolt, then the threads at joint 20 should be left-handed. When the threads at joint 20 are opposite to the direction of tool rotation, then rotation will force motor housing 12 and clutch housing 14 together, rather than apart, during operation.

As shown in FIG. 1, the lip of clutch housing 14 nearest joint 20 abuts the ends of male tabs 26 and 28 and thereby prevents axial movement of sleeve 10. The locking provided at the sides of the two sets of tabs prevents rotation of sleeve 10 about housings 12 and 14.

Sleeve 10 can also be fitted on a hand-held air tool which is actuated by a lever which extends substantially parallel to, but slightly upwardly from, the length of motor housing 12. Installing sleeve 10 on such a tool is carried out as described above, with the sole difference being that the lever should not sit directly above one of the trilobular edges formed by corners 11 of sleeve 10. Sleeve 10 should instead be aligned so that the lever is above one of its three sides 13.

As noted above, the distal sections of clutch housing 14 have a smaller diameter than the section nearest joint 20. However, a number of variations of the diameter of the clutch housing, and its various sections, as well as of the motor housing 12 are possible. The only requirement is that with the tabular locking system shown, the diameter of the sections of motor housing 12 and clutch housing 14 which are nearest tabs 22 and 24 must be approximately the size of bore 18 in order to lock the two sets of tabs and prevent relative movement of sleeve 10.

Generally, sleeve 10 must be constructed of a relatively rigid material. If the material is readily deformable, male tabs 26 and 28 could be twisted completely out of locking position by the reaction torque between sleeve 10 and housings 12 and 14 occurring when sleeve 10 is gripped tightly to resist the rotation of the tool. In the preferred embodiment, sleeve 10 is constructed of Fiberglass (TM) reinforced nylon; however, any of a number of materials with sufficient rigidity can also be used.

The above-described locking system is advantageous because it is simple in design, relatively inexpensive to manufacture, and makes installation and removal of sleeve 10 relatively easy. To remove sleeve 10, in the event that any portion of the tool needs repair, maintenance or replacement, one simply unthreads clutch housing 14 and motor housing 12 and pulls them apart Sleeve 10 can be re-used elsewhere after removal, or replaced onto assembled housings 12 and 14 as described above. The act of removal does not destroy or in any way impair sleeve 10.

Although the aforementioned locking system has several advantages, a number of other locking systems can be used with the invention. The primary requirement is that the system selected provide a secure lock between sleeve 10 and assembled housings 12 and 14. In addition, variations of the locking system described above can be made. For example, the location, number, shape and position of the tabs can be changed.

A typical rotating air-powered tool used with sleeve 10 is intended for use by a worker on an assembly line. Such a tool has a valve head (not shown) which is threaded to motor housing 12 by means of threads 34. See FIG. 5. An air hose (not shown) is threaded to the opposite end of the valve head The air hose provides access for the compressed air which drives the motor in motor housing 12.

Typically, the tool hangs above a worker, suspended by the elastic action of the coiled air hose, by a cable attached to the valve head, or by some other means. When the worker is ready to use the tool, he/she reaches up and grabs the tool by sleeve 10 and pulls it down. After finishing the task, the worker releases sleeve 10 to allow the tool to be pulled up and out of the way.

The worker must be able to grab the tool and quickly get it in position for performing the work at hand if he is to keep pace on the assembly line. However, it is difficult to work quickly if the tool becomes slick with oil or perspiration. Air-powered tools can easily become coated with oil, as it is typically injected from into the air line to lubricate the air motor Perspiration, of course, emanates from the worker, who may not have time to wipe his brow or the palms of his hands while the assembly line is moving. Oil (or perspiration) reduces the coefficient of friction between the operator's skin and the tool.

To overcome these problems, sleeve 10 can be provided with an anti-slip coating. In a preferred embodiment, sleeve 10 has a mat finish, which is only slightly abrasive. A more abrasive finish could be an irritant to the hands over the course of a typical shift. The mat finish is also more pleasing in appearance than a more abrasive finish.

Another design consideration is that sleeve 10 should be a good thermal insulator. When operating an air tool the air inlet end often becomes very cold, due to the expansion of compressed air within the valve head and motor housing 12. Conversely, the end nearest to clutch housing 14 becomes warm, due to the friction generated while doing work. A good insulator, such as the Fiberglass (TM) reinforced nylon of the preferred embodiment shields the operator's hand from these extremes and provides greater comfort.

Sleeve 10 is preferably slightly longer than the width of a typical worker's palm. This allows sleeve 10, and thus the tool to which it is attached, to be grabbed quickly near the middle and still be in position to be used. If the sleeve was substantially longer than a worker's palm width it could easily be grabbed in a position in which the worker's hand would be too far from the tool to allow proper operation. Alternatively, if sleeve 10 were shorter than the palm width, the palm would extend over the ends and operation would be difficult and uncomfortable.

As noted above, in cross-section the non-flared portion of sleeve 10 preferably is about 3.5 cm from side to corner. Though this size provides a comfortable grip for most people, it can be varied if operators with larger or smaller hands are using the sleeve.

It should be understood that the terms and expressions used above are descriptive only and that the embodiments described are exemplary only. Accordingly, the scope of the invention is not to be limited by the foregoing terms and expressions but is defined only by the claims which follow and includes all equivalents, known and unknown, of the claimed subject matter.

What is claimed is:

1. In a rotational air tool having a substantially cylindrical motor housing and clutch housing which are joined with a threaded joint, as well as a sleeve with a substantially cylindrical bore designed to accommodate the housings, wherein the improvement comprises:

said sleeve being locked to said housings by a pair of radially inwardly extending male tabs on the inner bore of the sleeve which lockingly mate with a pair of oppositely extending female tabs on the outer surface of said housings, to prevent rotational and axial movement of the sleeve relative to the housings;

the outer surface of said sleeve having a trilobular cross-section, and being of substantially the same diameter over the majority of its axial length; and at least one end portion of said outer surface of said sleeve being flared radially outwardly along the axial length of the handle and wherein the flared end portion has a trilobular cross-sectional shape.

2. The device of claim 1, wherein the inner diameter of the sleeve is substantially the same along its entire length.

3. The device of claim 1, wherein the outer surface has a mildly abrasive finish.

4. The device of claim 1, wherein the sleeve is at least as long as the width of an operator's palm.

5. A tool and handle combination comprising:

a tool body formed of first and second coaxial cylindrical members having abutting ends held together by mating threads;

a recess in the cylindrical surface of one abutting end, said recess being closed in one axial direction by a shoulder on one member and in the other axial direction by a shoulder on the other member;

a handle having a cylindrical bore adapted to receive said body members; and an inwardly extending tab in said bore proportioned to substantially fill said recess both axially and circumferentially, so as to prevent significant relative motion of said handle on said tool body.

* * * * *